US009873487B1

(12) United States Patent
Eekhoff et al.

(10) Patent No.: US 9,873,487 B1
(45) Date of Patent: Jan. 23, 2018

(54) HYBRID RUNNING SURFACE BOAT

(71) Applicant: Pontoon Boat LLC, Elkhart, IN (US)

(72) Inventors: Trent Allan Eekhoff, Grand Rapids, MI (US); Brad Roy Fishburn, Nappanee, IN (US); Jacob Steven Vogel, Granger, IN (US); Anthony Duane Williams, Maryville, TN (US)

(73) Assignee: Pontoon Boat LLC, Elkhart, IN (US)

( * ) Notice: Subject to any disclaimer, the term of this patent is extended or adjusted under 35 U.S.C. 154(b) by 0 days.

(21) Appl. No.: 15/236,778

(22) Filed: Aug. 15, 2016

Related U.S. Application Data

(63) Continuation-in-part of application No. 14/520,711, filed on Oct. 22, 2014, now Pat. No. 8,415,836.

(60) Provisional application No. 61/895,643, filed on Oct. 25, 2013.

(51) Int. Cl.

| | |
|---|---|
| ***B63B 17/00*** | (2006.01) |
| ***B63B 3/00*** | (2006.01) |
| ***B63B 1/12*** | (2006.01) |
| ***B63B 3/48*** | (2006.01) |
| ***B63B 35/38*** | (2006.01) |

(52) U.S. Cl.
CPC ..... *B63B 3/00* (2013.01); *B63B 1/125* (2013.01); *B63B 3/48* (2013.01); *B63B 35/38* (2013.01)

(58) Field of Classification Search
CPC .. B63B 3/00; B63B 3/48; B63B 1/125; B63B 35/38
See application file for complete search history.

(56) References Cited

U.S. PATENT DOCUMENTS 3,002,484 A * 10/1961 Dube ..... B63B 1/14 114/123
3,230,918 A * 1/1966 Compton ..... B63B 1/14 114/283
3,401,663 A * 9/1968 Yost ..... B63B 1/14 114/283
3,702,106 A * 11/1972 Wilder ..... B63B 43/14 114/123
3,996,871 A * 12/1976 Boismard ..... B63B 1/125 114/283
4,348,972 A * 9/1982 Parsons ..... B63B 1/042 114/357
4,762,078 A * 8/1988 Palmer, Jr. ..... B63B 1/125 114/345
4,964,357 A * 10/1990 Genfan ..... B63B 1/24 114/123
5,184,564 A * 2/1993 Robbins ..... B63B 7/082 114/345
6,000,355 A * 12/1999 Hall ..... B63B 1/125 114/123
6,016,762 A * 1/2000 Price ..... B63B 1/18 114/274
6,115,860 A * 9/2000 Vrzalik ..... A61G 7/001 5/710

(Continued)

*Primary Examiner* — Stephen P Avila
(74) *Attorney, Agent, or Firm* — Faegre Baker Daniels LLP

(57) ABSTRACT

In one embodiment of the invention, a boat is provided which includes a deck; a plurality of pontoons extending in a direction parallel to a longitudinal axis of the deck, the deck being attached to the pontoons; and a hull portion attached to and extending from one of the pontoons. The hull portion extends outwardly to a distance wider than the pontoon to which it is attached, and the hull portion extends farther rearwardly than any of the pontoons.

20 Claims, 18 Drawing Sheets

(56) References Cited

U.S. PATENT DOCUMENTS

| | | | | |
|---|---|---|---|---|
| 6,932,012 | B1 * | 8/2005 | Philips | B63B 1/125 114/61.1 |
| 6,988,456 | B1 * | 1/2006 | Schooler | B63B 1/125 114/344 |
| 8,474,393 | B1 * | 7/2013 | Chandler | B63B 3/08 114/352 |
| 2002/0023579 | A1 * | 2/2002 | Profitt | B63B 1/125 114/61.12 |

* cited by examiner

HYBRID RUNNING SURFACE BOAT

This application is a continuation-in-part application of U.S. patent application Ser. No. 14/520,711 filed on Oct. 22, 2014, which claims priority from U.S. Provisional Patent application Ser. No. 61/895,643 filed on Oct. 25, 2013, the entirety of which are incorporated by reference as if fully rewritten herein.

BACKGROUND OF THE INVENTION

This invention relates to a hybrid running surface boat, and in particular to a boat having a combination of pontoons and a hull structure.

Boating has become an increasingly popular form of recreation, leisure and platform for water sports. One type of boat, namely, pontoon boats, which have two or more longitudinally extending flotation devices with buoyancy sufficient to float itself as well as a deck, seats, and other boat equipment attached thereto as well as passengers, have also seen a rise in popularity. Pontoon boats provide an economical way to provide a large deck area accommodating many passengers as well as a smooth ride. Pontoon boats are particularly suited for inland lakes and rivers that do not have large waves.

Pontoon boats have become increasingly more elaborate with many convenience features as well as increased power. Pontoon boats are now offered with sufficient engine capacity to pull one or more water skiers or wake board riders; however, the wake produced by a traditional pontoon boat lacks the distinct and high crest that is generated by single hull ski boats and desired by skiers and wake board riders, especially by those who are advanced in the sport.

Accordingly, it is an object of the present invention to provide a boat having a hybrid running surface, that is, one having a combination of pontoons and a hull profile to provide the smooth ride and large deck area of a pontoon boat, yet offering improved wake characteristics for skiing and wake boarding.

Prior art boats having hulls and/or pontoons include U.S. Pat. No. 4,762,078 to Palmer Jr. et al. (the '078 patent), the entirety of which is incorporated by reference herein, discloses an inflatable aquatic vessel having an in-board engine hull mated with a modified inflatable pontoon. The hull portion is designed as an in-board engine well without consideration of wake characteristics.

U.S. Pat. No. 4,348,972 to Parsons (the '972 patent), the entirety of which is incorporated by reference herein, discloses a multipurpose trimaran. The trimaran has a central hull and two side hulls.

U.S. Pat. No. 6,988,456 to Schooler (the '456 patent), the entirety of which is incorporated by reference herein, discloses a personal watercraft including a hull and at least two pontoons repositionally attached to the hull with at least one pontoon attached approximate the starboard side and at least one pontoon attached approximate the port side.

U.S. Pat. No. 6,932,012 to Philips et al. (the '012 patent), the entirety of which is incorporated by reference herein, discloses a multi-hull surface vessel with drag reduction on lateral hulls. The vessel includes a main hull and at least two lateral hulls disposed respectively on opposite sides of the main hull.

U.S. Pat. No. 6,016,762 to Price (the '762 patent), the entirety of which is incorporated by reference herein, discloses a planing foil for twin hull boats. Price discloses a standard pontoon boat having pontoons and a planing foil located toward the rear center underneath the deck to lift the boat and reduce drag.

U.S. Pat. No. 6,000,355 to Hall (the '355 patent), the entirety of which is incorporated by reference herein, discloses a watercraft having an elongated central V-type hull 60 and first and second stabilizers along the sides thereof. Each stabilizer includes an elongated flotation member having its longitudinal center aligned with the center of the hull. The stabilizers are retractably mounted on respective sides of the hulls with scissor arm type mounts.

U.S. Pat. No. 5,184,564 to Robbins et al. (the '564 patent), the entirety of which is incorporated by reference herein, discloses an inflatable tube or pontoon configured to fit around a personal watercraft, such as jet ski. The pontoon has a generally V-shaped configuration with a closed front end and an open back end for receiving the jet ski.

U.S. Pat. No. 4,964,357 to Genfan (the '356 patent), the entirety of which is incorporated by reference herein, discloses a planing boat having a tube-like hull, a hydrofoil fixed to the front portion of the tube-like hull and a pair of floats attached to the hull. The floats include pivoting wings. When the boat stops and at low speeds, the floats are in the water, and when the boat is at a high speed, the operator lifts the floats out of the water using the pivoting wings. At the highest speed an operator puts the wings parallel to the water surface and the ground effect is used.

U.S. Pat. No. 3,996,871 to Boismard (the '871 patent), the entirety of which is incorporated by reference herein, discloses a vessel with hydroplaning hulls. In one embodiment, the vessels include a central hull and side hulls. The side hulls are set forward of the central hull.

U.S. Pat. No. 3,702,106 to Wilder (the '016 patent), the entirety of which is incorporated by reference herein, discloses a watercraft construction including a main hull portion and outrigger portions that are pivotally connected to the main hull for pivoting thereabout.

U.S. Pat. No. 3,401,663 to Yost (the '663 patent), the entirety of which is incorporated by reference herein, discloses a catamaran boat having lateral hull members and a central spray shield extending between the lateral hull members.

U.S. Pat. No. 3,230,918 to Compton (the '918 patent), the entirety of which is incorporated by reference herein, discloses a catamaran boat having a central hull and pivoting floats including a starboard float and a port float.

U.S. Pat. No. 3,115,860 to Payne (the '860 patent), the entirety of which is incorporated by reference herein, discloses a skiff having a standard skiff hull configuration and pontoons along opposite sides thereof to cause the skiff to plane over water whether under its own power or being towed.

U.S. Pat. No. 3,002,484 to Dube (the '484 patent), the entirety of which is incorporated by reference herein, discloses a boat having a standard hull configuration and pivotally connected lateral pontoons that are pivotally mounted to the boat.

None of the prior art discloses a hybrid running surface including a plurality of pontoons and a combination pontoon and hull portion designed to provide a wave or good wake characteristics.

SUMMARY OF THE INVENTION

In one embodiment of the invention, a boat is provided which includes a deck; a plurality of pontoons extending in a direction parallel to a longitudinal axis of the deck, the deck being attached to the pontoons; and a hull portion attached to and extending from one of the pontoons. The hull portion extends outwardly to a distance wider than the pontoon to which it is attached, and the hull portion extends farther rearwardly than any of the pontoons.

A part of the hull portion may not extend as far downwardly from the deck as the pontoons. The hull portion may also not extend as far downwardly from the deck as the pontoon to which it is attached in the area of attachment.

There may be three pontoons including two outward pontoons and a middle pontoon, with the hull portion being attached to the middle pontoon. The rear ends of the outward pontoons can be curved or angled so that outer ends of the outward pontoons extend back farther from a front of the boat than along the inner sides. The hull portion may extend downwardly further from said deck at a rear end thereof than said pontoons.

In another embodiment of the invention, a boat is provided which includes a deck; a plurality of pontoons extending in a direction parallel to a longitudinal axis of the deck, the deck being attached to the pontoons; and a hull portion attached to and extending from one of the pontoons. The hull portion and the pontoons having a rigid construction and are manufactured from the same materials, and at least a portion of the hull extends to a different depth from the deck than the pontoon to which it is attached. The hull portion may extend outwardly to a distance wider than the pontoon to which it is attached, and may extend farther rearwardly than any of the pontoons.

A portion of the hull may not extend as far downwardly from the deck as the pontoons. There can be three pontoons that may include two outward pontoons and a middle pontoon, and the hull portion can be attached to the middle portion. The hull portion may extend downwardly farther from the deck at a rear end thereof than the pontoons. The pair of outward pontoons may have curved or angled aft ends so that outward portions of the pontoons extend back further from a front end of the boat than along inner sides of the outward pontoons.

In yet another embodiment of the invention, a boat is provided which includes a deck; a plurality of pontoons extending in a direction parallel to a longitudinal axis of the deck, the deck being attached to the pontoons; and a hull portion attached to and extending from one of the pontoons, wherein the hull portion has a varied width, being narrowest where attached to the pontoon and widest at an aft end thereof. The hull portion may extend farther rearwardly than any of the pontoons. A portion of the hull may extend downwardly to a different depth than the pontoon to which it is attached. There may be three pontoons that include two outward pontoons and a middle pontoon, and the hull portion may be attached to the middle pontoon. The rear ends of the outward pontoons can be curved or angled so that the outer ends of the outward pontoons extend back further from a front of the boat than along the inner sides of the outward pontoons. A rear end of the hull may extend outwardly beyond at least a portion of the outward pontoons.

BRIEF DESCRIPTION OF THE DRAWINGS

The above-mentioned and other features and objects of this invention and the manner of obtaining them will become more apparent and the invention itself will be better understood by reference to the following description of embodiments of the present invention taken in conjunction with the accompanying drawings, wherein.

Figure 1:
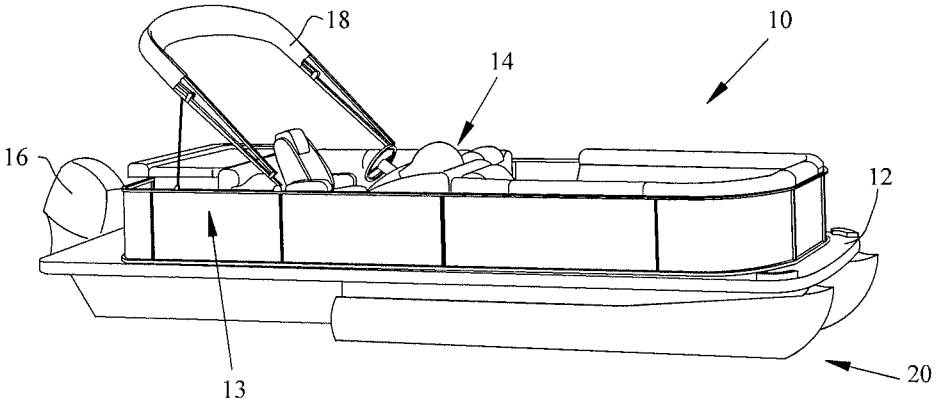
FIG. 1 is a perspective view of a first embodiment pontoon boat having a hybrid running surface in accordance with the subject invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Now referring to FIG. 1, a pontoon boat is shown, generally indicated as 10. Pontoon boat 10 includes a deck 12; a railing 13 extending around the outer periphery of deck 12; a seating arrangement, generally indicated as 14; an outboard motor 16; and an adjustable canopy 18, all of which may be of a variety known to one skilled in the art. Pontoon boat 10 also includes a hybrid running system in accordance with the subject invention, generally indicated as 20, to provide flotation of boat 10 in water while either stationary or in motion.

Figure 2:
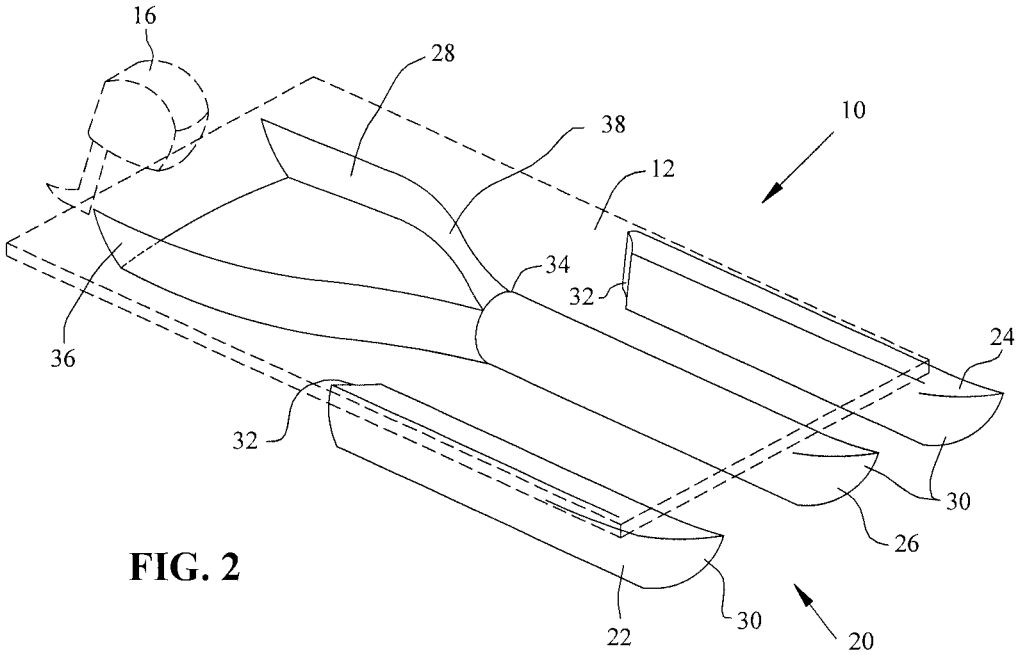
FIG. 2 is a perspective view of the hybrid running surface of the pontoon boat of FIG. 1 with the deck and equipment mounted to the deck removed, but with the deck and motor shown in phantom lines.
Figure 3:
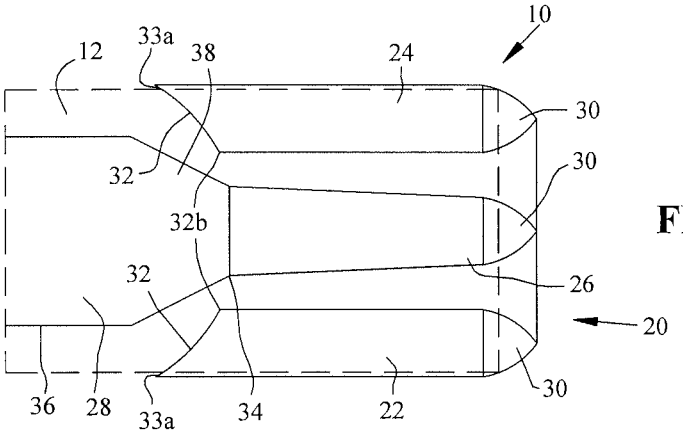
FIG. 3 is a plan view of FIG. 2.
Figure 4:
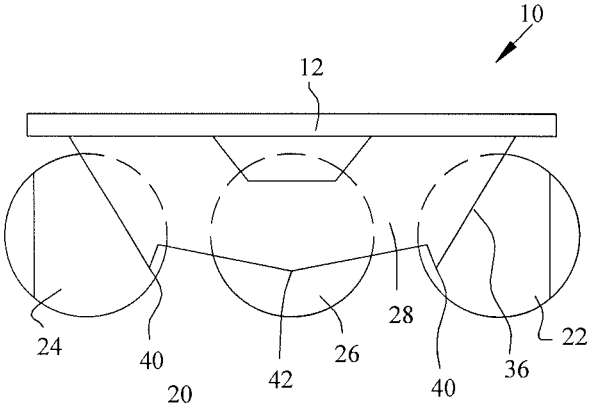
FIG. 4 is an aft view of FIG. 2.

Now referring to FIGS. 2-4, hybrid running surface 20 includes two outer pontoons, 22 and 24, and a combination middle pontoon, 26 and hull section/portion 28. In the embodiment shown, hull portion 28 is attached to and mounted to the rear of pontoon 26, which is located intermediate between outer pontoons 22 and 24. Pontoons 22, 24 and the front portion of pontoon 26 are manufactured in accordance with known methods for constructing pontoons. Furthermore, the pontoons and hull portion 28 are constructed from known suitable materials for pontoon and boat construction including, but not limited to metals such as aluminum, steel, or stainless steel; composite materials such as fiberglass, or suitable plastic polymers. In the embodiment shown, each of the pontoons 24-26 has a tapered front portion 30 for facing and cutting into the water. In addition, pontoons 22 and 24 have curved or angled aft ends 32 that extend farther backward along the outer edges 33*a* than towards the inner portions 33*b* (as best shown in FIG. 3) to accommodate hull portion 28 and facilitate water flow.

It should further be appreciated that deck 12 is mounted to pontoons 22-26 and hull 28 using conventional methods.

Combination pontoon 26 and hull portion 28 are attached to one another at a junction 34. Hull portion 28 has a varied width and in the embodiment shown, is widest towards its aft end 36 and narrowest at a front end 38 where it is attached to pontoon 26. This configuration serves a joint purpose in that it transitions via attachment at forward end 38 to pontoon 26 while maintaining a wider aft end to produce the desired wake characteristics. Furthermore, in this embodiment, hull portion 28 does not extend as far below deck 12 as pontoons 22-26 do (see FIG. 4). It should be appreciated that at juncture 34, a sharp transition in height between hull portion 28 and pontoon 26 may be made or hull portion 26 may be gradually tapered downward to meet at the same depth or distance from deck 12 as the bottom of pontoon 26 extends. It should be appreciated that the attachment of hull 28 to pontoon 26 may be made by welding or other known means.

Also, in the embodiment shown in FIG. 4, hull portion 28 has a generally V-shaped or tapered cross-section being narrower at the bottom than towards the top. In addition, hull portion 28 includes two extension portions 40 for riding and wave characteristics. The remaining bottom of hull portion 28 is tapered down to a ridge 42 extending along a midline thereof.

Figure 5:
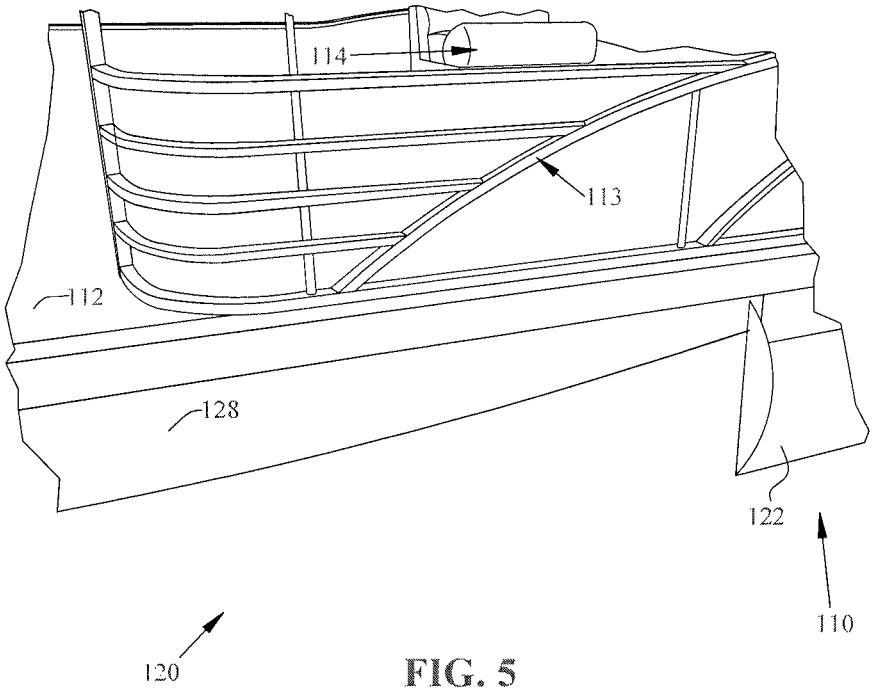
FIG. 5 is a close up perspective view of another embodiment of a pontoon boat and hybrid running surface in accordance with the subject invention.
Figure 6:
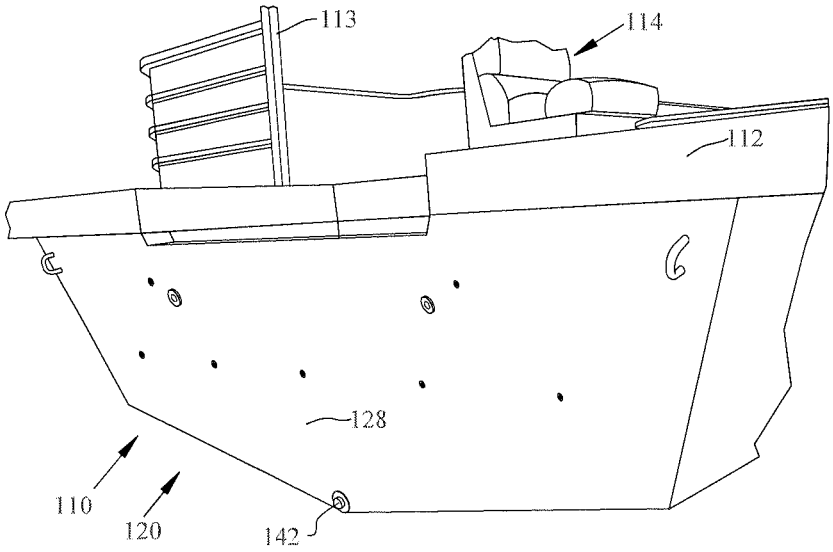
FIG. 6 is a perspective aft view of the pontoon boat of FIG. 5.

Now referring to FIGS. 5 and 6, another embodiment of a pontoon boat is shown, generally indicated as 110. Pontoon boat 110 is similar in many respects to pontoon boat 10 and includes a deck 112; a railing 113 extending around the periphery of deck 112; a seating arrangement, generally indicated as 114; and a hybrid running surface, generally indicated as 120. Pontoon boat 110 includes pontoons similar to that of pontoon boat 10, but has a modified hull portion 128. Hull portion 128 does not have extension portions along the bottom ends, but does include a middle ridge 142 extending along a midline thereof. Furthermore, the aft end of hull portion 128 may extend farther downwardly from deck 112 than pontoon 122 or any of the other pontoons (not shown).

Referring now to FIGS. 7-15, another embodiment of a hybrid running surface is shown generally indicated as 20, with the pontoon boat removed for clarity, but a deck 212 shown in phantom lines.

Figure 7:
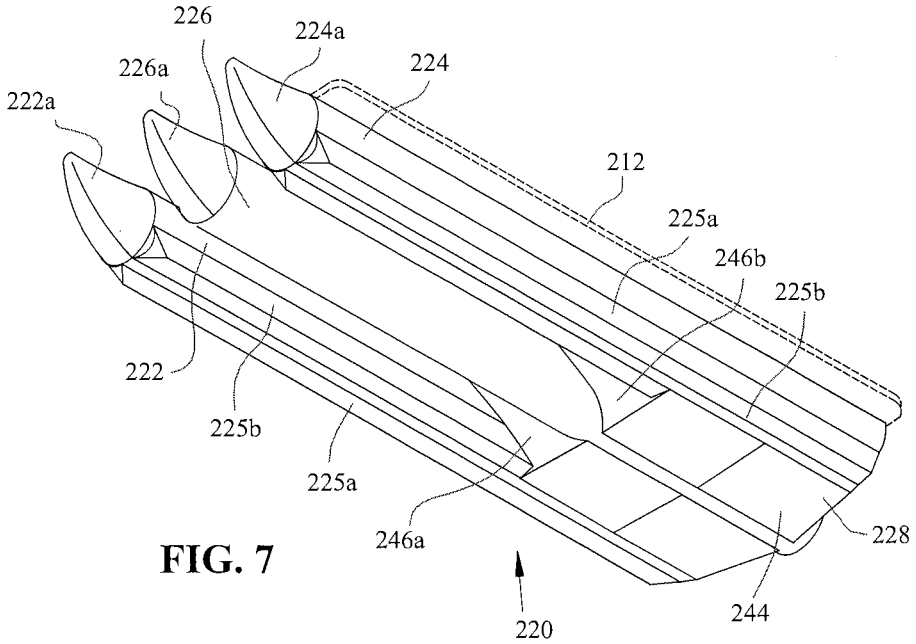
FIG. 7 is a bottom perspective view of yet another embodiment of a pontoon boat having a hybrid running surface in accordance with the subject invention.
Figure 11:
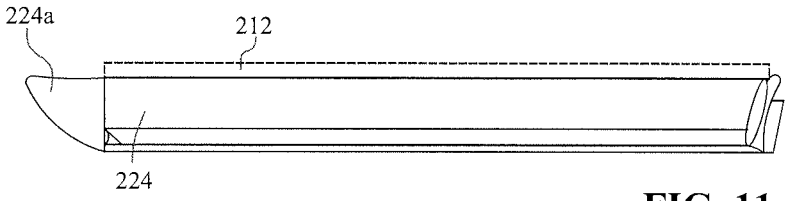
FIG. 11 is a side view of the hybrid running surface of FIG. 7.

Hybrid running surface 220 includes two outer pontoons 222 and 224, a middle pontoon 226, and a hull section/portion 228. Pontoon portions 222, 224, and 226 are manufactured in accordance with known methods for constructing pontoons. The materials used are similar to pontoons 22, 24, and 26 discussed above. Also, each pontoon 222, 224, and 226 includes a respective nose 222*a*, 224*a*, and 226*a*, which may curve or turn upward as best shown in FIGS. 7 and 11 to enhance travel through water. Additionally, in the embodiment shown, pontoons 222 and 224 each include a pair of extensions 225*a* and 225*b* that run longitudinally along the pontoons from noses 222*a* and 224*a* to the rear thereof. Extensions 225*a*, 225*b* have a generally triangular cross-section and are spaced apart towards the bottom of the pontoons (as best shown in FIGS. 7 and 9) to enhance stability and performance.

Figure 12:
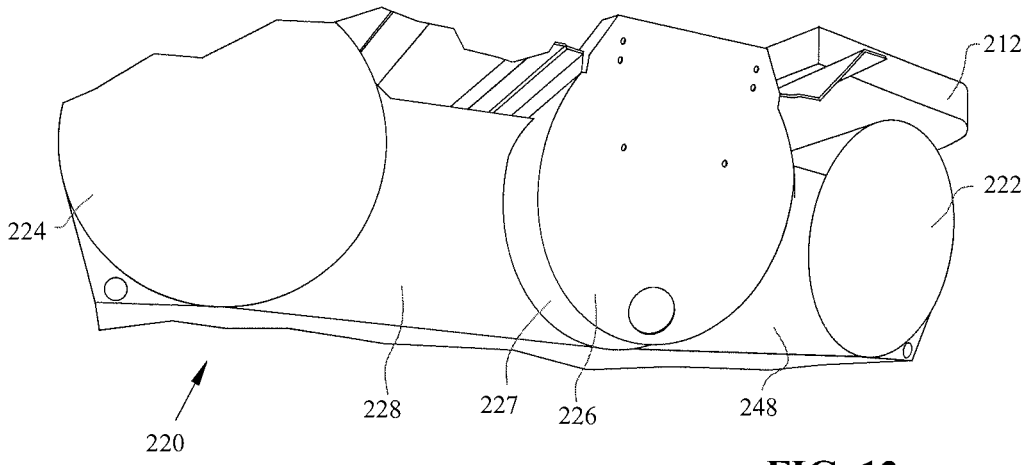
FIG. 12 is a rear perspective view of the hybrid running surface of FIG. 7.

From FIG. 12, it can be seen that the rear end of pontoons 222 and 224 are flush with the back end of hull 228. Middle pontoon 226, though, has a rear extended portion 227.

Figure 8:
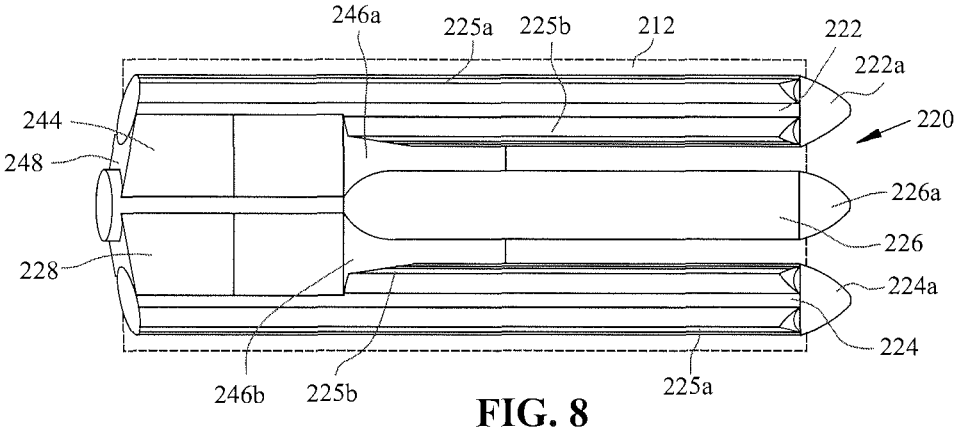
FIG. 8 is a bottom view of the hybrid running surface of the pontoon boat in FIG. 7.
Figure 9:
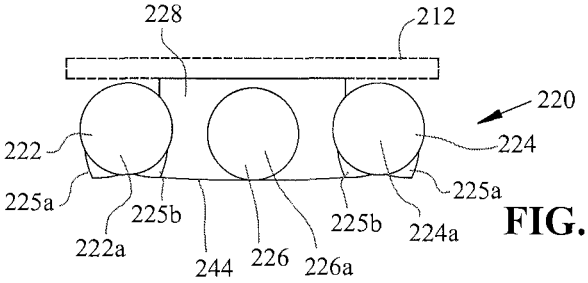
FIG. 9 is a front view of the hybrid running surface of FIG. 7.
Figure 10:
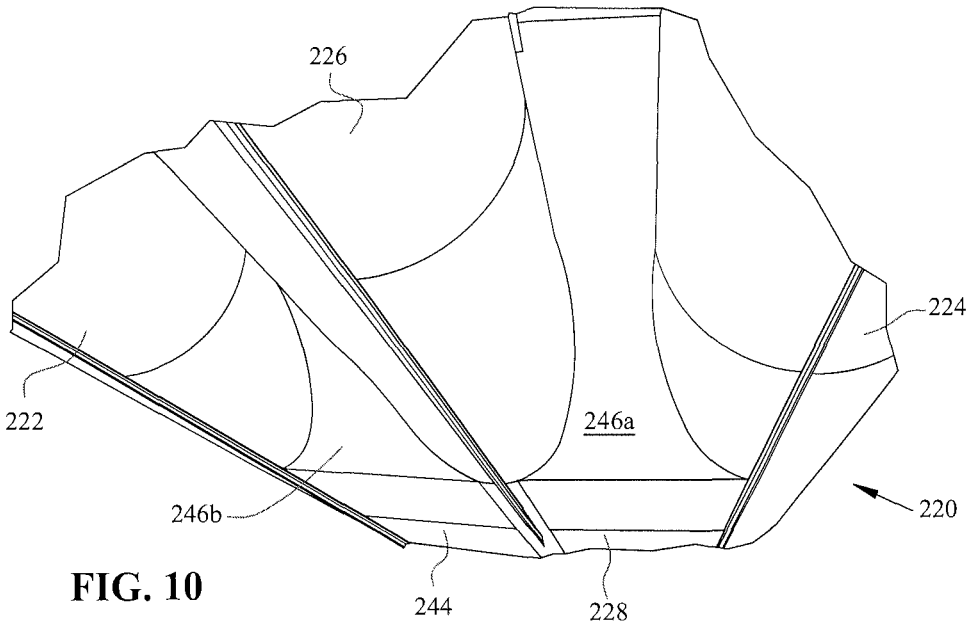
FIG. 10 is an enlarged bottom perspective view of the hybrid running surface of FIG. 7.
Figure 15:
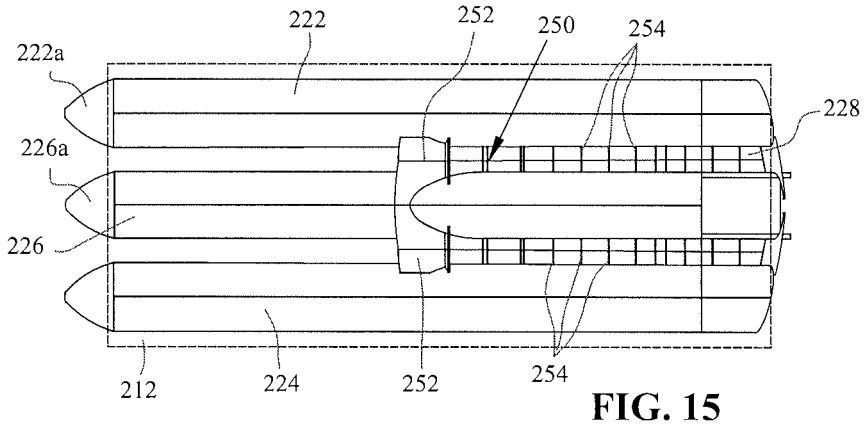
FIG. 15 is a top plan view of the hybrid running surface of FIG. 7 with the deck in phantom lines and showing interior structure.
Figure 13:
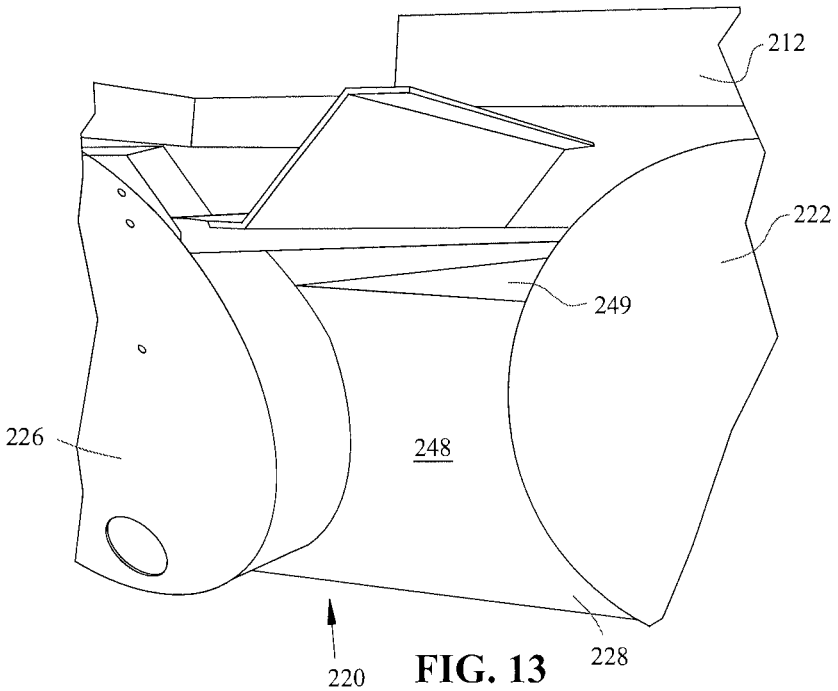
FIG. 13 is an enlarged rear perspective view of the hybrid running surface of FIG. 7.
Figure 14:
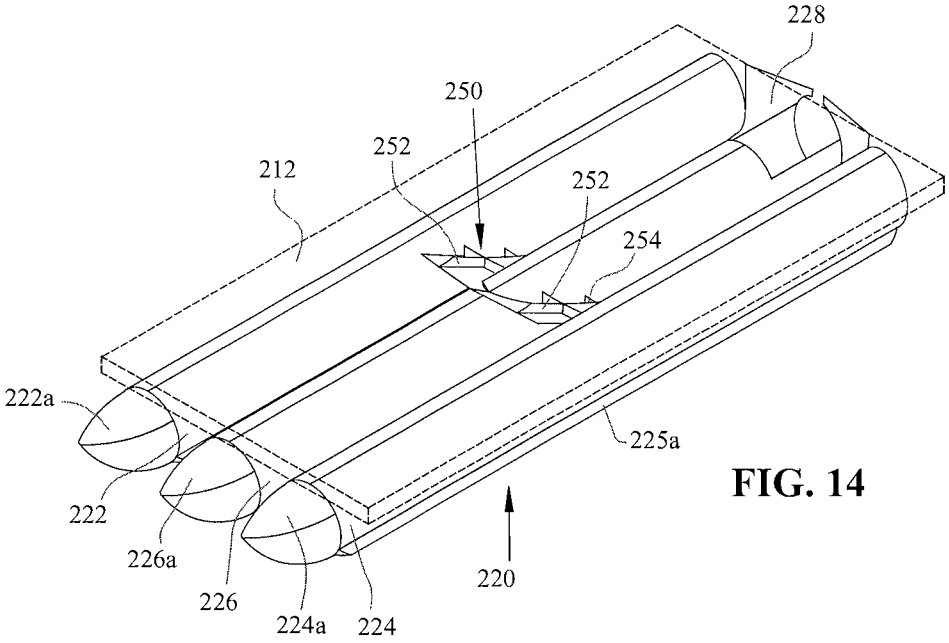
FIG. 14 is a top perspective view of the hybrid running surface of FIG. 7 with a deck in phantom lines and showing interior structure.

Regarding hull portion 228, a bottom 244 of hull portion 228 is approximately flush with pontoons 222, 224, and 226 as shown in FIG. 9. Additionally, hull portion 228 includes two spaced apart sloping surfaces 246*a* and 246*b* on opposite sides of middle pontoon 226 and extending to respective outer pontoons 222 and 224. It should be appreciated that sloping surfaces 246*a*, 246*b* enhance pushing water down and beneath bottom surface 244 of hull portion 228 to enhance the wake characteristics behind the boat. At the rear of hull portion 228, a back panel 248 of the hull portion inclines extending outwardly on each side from pontoon 226 as best shown in FIG. 8 so that the middle of back panel 248 extends farther rearwardly, than the outer ends. Referring to FIG. 13, it can be seen that the top of hull portion 228 includes a panel 249 on each side of pontoon 226 to enclose hull structure 228. Referring now to FIGS. 14 and 15, hull portion 228 may include an internal support or stiffening structure, generally indicated as 250, which in the embodiment shown includes longitudinal members 252 and a plurality of cross members 254. Hull portion 228 may be welded to pontoons 222, 224, and 226, where they abut, or other known joining or fabrication methods may be employed. In this embodiment, hull portion 228 is located at approximately the rear % portion of the boat structure, with the upper forward portion of sloped portions 246*a* and 246*b* extending farther to the front of the craft.

Figure 16:
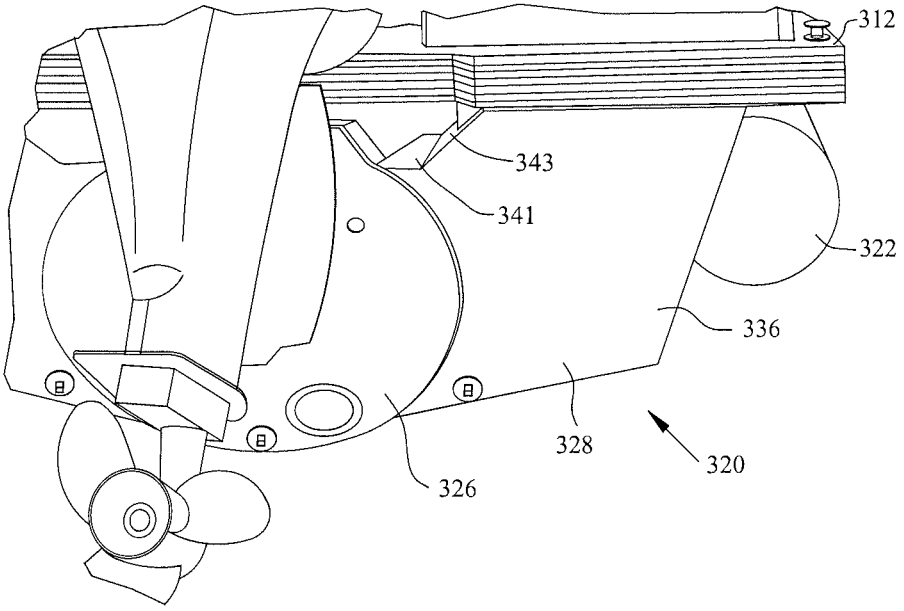
FIG. 16 is a rear perspective view of yet another alternate embodiment hybrid running surface.
Figure 17:
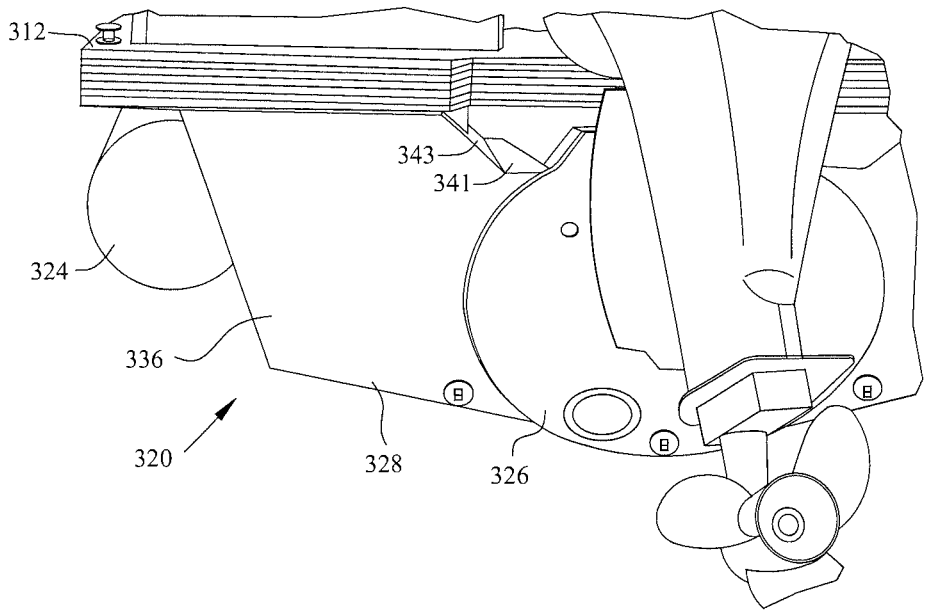
FIG. 17 is a rear perspective view of the other side of the alternate embodiment hybrid running surface of FIG. 16.
Figure 18:
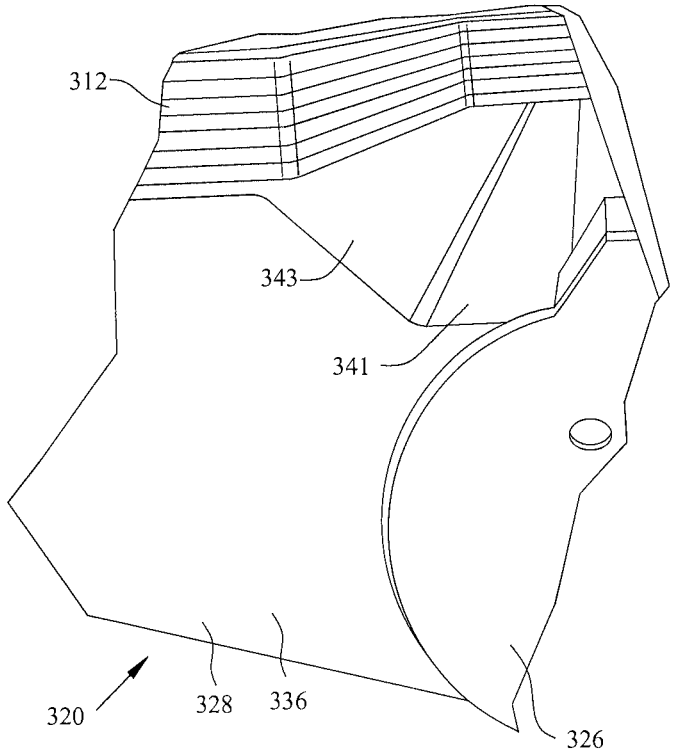
FIG. 18 is an enlarged view of the top rear combination hull of the hybrid running surface of FIG. 16.
Figure 19:
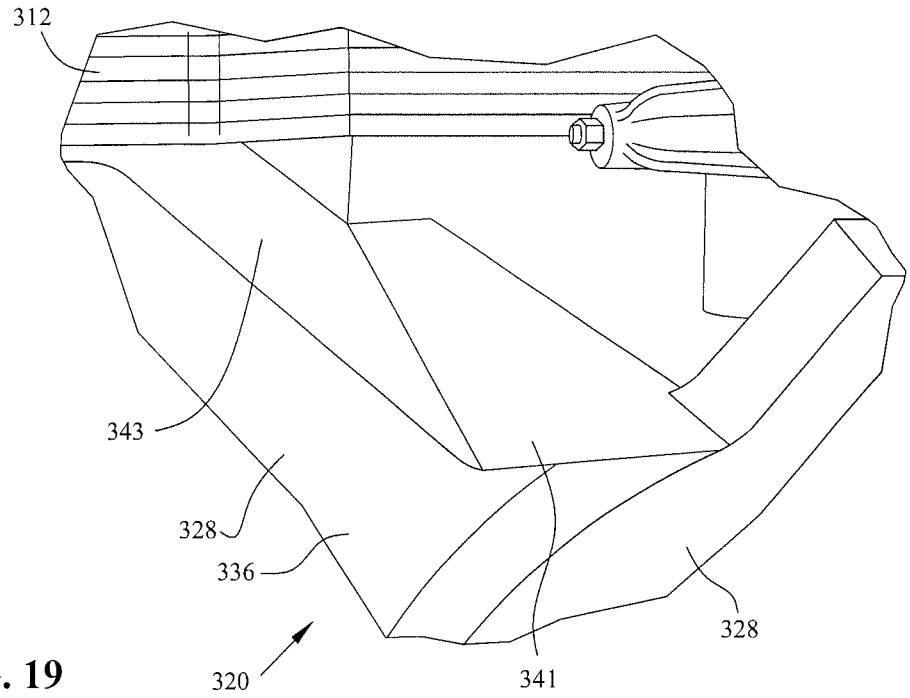
FIG. 19 is another perspective rear top end view of the combination hull of the hybrid running surface of FIG. 16.

Now referring to FIGS. 16-21, yet another alternate embodiment hybrid running surface for a boat is generally indicated as 320. Hybrid running surface 320 is mounted to a deck 312 and in the embodiment shown, includes outer pontoons 322 and 324 and a middle pontoon 326 running longitudinally beneath deck 312 and spaced apart from one another. Hybrid running surface 320 also includes a combination hull portion 328 that is attached to and at least partially surrounds a portion of middle pontoon 326 as best shown in FIGS. 16-17.

Figure 20:
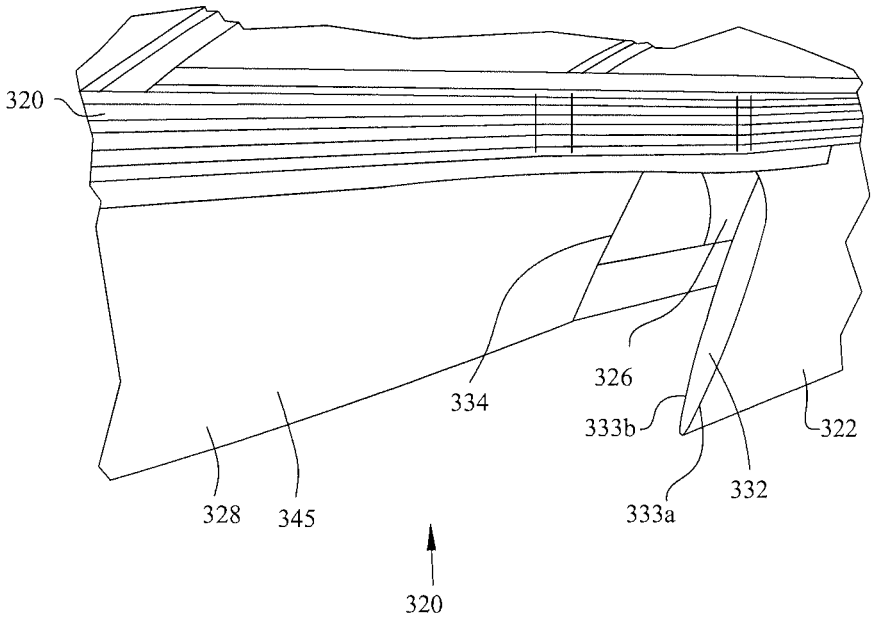
FIG. 20 is a side perspective view of the hybrid running surface of FIG. 16.
Figure 21:
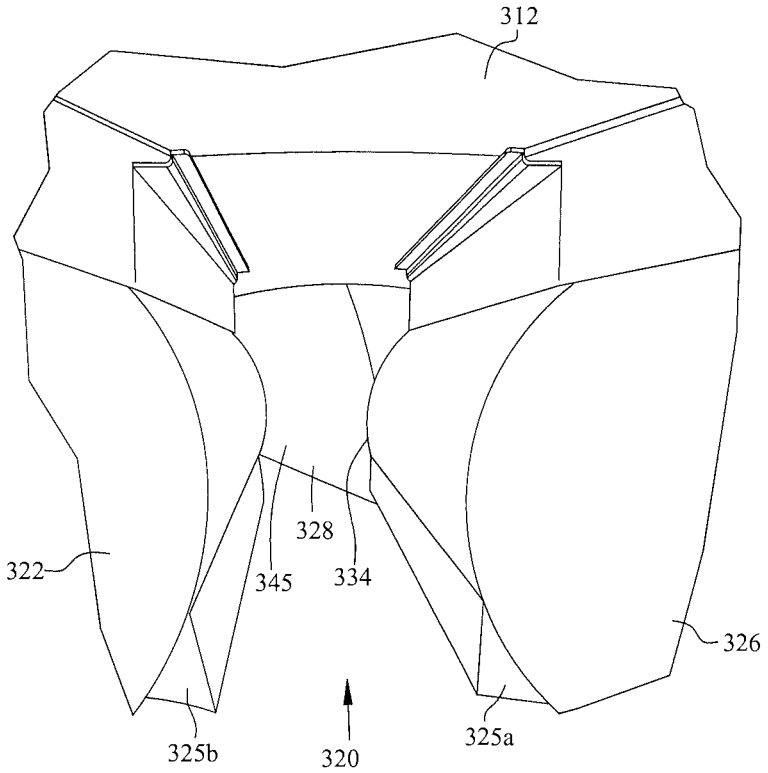
FIG. 21 is a front perspective view between an outer pontoon and the middle pontoon of the hybrid running surface of FIG. 16.

As shown in FIGS. 20 and 21, outer pontoons 322 and 324 do not extend to the rear deck 312, but rather are cut short thereof. In one embodiment, outer pontoons 322 and 324 include an angled rear end 332. Angled rear end surfaces 332 includes an outer rear edge 333*a* and an inner rear edge 333, as best shown in FIG. 20. In the embodiment shown in FIG. 20, outer rear edge 333*a* extends rearwardly further along deck 312 than does inner rear edge 333*b*. As with other hybrid running surfaces discussed above, pontoons 322, 324 and 326 may include extensions 325*a* and 325*b* as best shown in FIG. 21.

Regarding middle pontoon 326, it extends further rearwardly than either of the outer pontoons (322 or 324) or combination hull portion 328 as best shown in FIGS. 16-19. Hull portion 328 is joined with middle pontoon 326 at junction 334 (FIGS. 20 and 21). Hull portion 328 further includes angled side surfaces 345 extending rearwardly and outwardly from junction 334. As best shown in FIGS. 16-19, hull portion 328 further includes a planar surface 341 connecting the hull portion to middle to pontoon 326 and a sloped surface 343 extending upward from surface 341.

As should be appreciated by one skilled in the art, when hybrid running surface 320 is in motion in a body of water, hull portion 328, the pontoons, and the spaces between middle pontoon 326 and respective outer pontoons 322 and 324, allow hybrid running surface 320 to produce good wake characteristics in the body of water in which it is being propelled through.

While the invention has been taught with specific reference to these embodiments, one skilled in the art will recognize that changes can be made in form and detail without departing from the spirit and scope of the invention. For example, it is possible to have the rear part of the hull portion extend out even wider than shown so that its width equals or exceeds the width between the outer pontoons. Additionally, other changes may be made in the shape of the hull to enhance the wake characteristics. The described embodiments are to be considered, therefore, in all respects only as illustrative and not restrictive. As such, the scope of the invention is indicated by the following claims rather than by the description.

The invention claimed is:

1. A boat including:

a deck;

a plurality of pontoons extending in a direction parallel to a longitudinal axis of the deck, the deck being attached to said pontoons; and a hull portion attached to and extending between a portion of said pontoons, said hull portion extending from an aft end of the boat forward to approximately midway of the deck and substantially less than a forward end of the deck and extending downwardly to a distance proximate the pontoons to which it is attached, said hull portion including a sloped surface that extends longitudinally toward a front of the boat.

2. The boat as set forth in claim 1, wherein there are three pontoons including two outward pontoons and a middle pontoon, and said hull portion is attached to said middle pontoon and extending outward and attached to said outward pontoons.

3. The boat as set forth in claim 2, wherein said hull portion includes two sloped surfaces, one of each surface located between said middle pontoon and a respective outward pontoon.

4. The boat as set forth in claim 3, wherein the sloped surfaces extend farther to the front end of the boat toward tops of the pontoons as compared to bottoms of the pontoons.

5. The boat as set forth in claim 4, including longitudinal extensions attached to a plurality of the pontoons.

6. The boat as set forth in claim 5, wherein the outward pontoons each include two longitudinal extensions having a generally triangular shaped cross sectional configuration and located toward the bottom of said pontoons.

7. A boat including:

a deck;

a plurality of pontoons extending in a direction parallel to a longitudinal axis of the deck, the deck being attached to said pontoons; and a hull portion attached to and extending from a middle pontoon to outer pontoons, said hull portion and said pontoons having a rigid construction and manufactured from the same materials, and at least a portion of said hull surrounding a substantial portion of the middle pontoon to which it is attached.

8. The boat as set forth in claim 7, wherein said hull portion extends outwardly to a distance wider than the middle pontoon to which it is attached.

9. The boat as set forth in claim 8, wherein said hull portion extends farther rearwardly than said outer pontoons.

10. The boat as set forth in claim 7, wherein said hull portion does not extend as far forward as said pontoons.

11. The boat as set forth in claim 7, wherein the middle pontoon, extends rearwardly beyond said hull portion and said outer pontoons.

12. The boat as set forth in claim 7, wherein said hull portion extends farther forward nearer said deck than at a lower area remote from the deck.

13. The boat as set forth in claim 12, including a stiffening structure in said hull having longitudinal support members and cross members.

14. A boat including:

a deck;

a plurality of pontoons extending in a direction parallel to a longitudinal axis of the deck, the deck being attached to said pontoons; and a hull portion attached to and extending from a middle pontoon to outer pontoons, said hull portion having a front end with a sloping surface, so that said hull portion is longer at a top end thereof than at a bottom end thereof.

15. The boat as set forth in claim 14, wherein said middle pontoon extends farther rearwardly than any of said other pontoons.

16. The boat as set forth in claim 15, wherein said middle pontoon extends farther rearwardly than said hull portion.

17. The boat as set forth in claim 16, wherein there are three pontoons including said two outer pontoons and said middle pontoon, and said hull portion is attached to all of said pontoons.

18. The boat as set forth in claim 17, wherein a rear end of said hull portion is angled so that outer ends of said rear end of said hull portion do not extend as far back from a front of the boat than a middle of the rear end of said hull portion.

19. The boat as set forth in claim 14, wherein said outer pontoons have extensions extending longitudinally thereon.

20. The boat as set forth in claim 19, wherein each outer pontoon has two extensions having a generally triangular shaped cross-section and the extensions are located proximate a lower end of said pontoons.

* * * * *